United States Patent [19]

Klatt

[11] Patent Number: 4,852,512

[45] Date of Patent: Aug. 1, 1989

[54] LOCATION MARKING STAKE

[76] Inventor: Richard J. Klatt, S86 W23640 Edgewood Ave., Big Bend, Wis. 53103

[21] Appl. No.: 183,589

[22] Filed: Apr. 19, 1988

[51] Int. Cl.[4] ..... G09F 17/00

[52] U.S. Cl. ..... 116/209; 116/173; 248/156; 248/545; 446/488

[58] Field of Search ..... 116/63 R, 63 P, 63 C, 116/209, 173–175; 52/103–105, 118, 165; 272/25; 248/156, 530, 532, 545; 446/69, 320, 488, 487; 493/959, 961; 40/601, 606, 607, 610, 612

[56] References Cited

U.S. PATENT DOCUMENTS

| | | | |
|---|---|---|---|
| 1,088,582 | 1/1914 | Bates | 52/165 |
| 3,225,734 | 11/1963 | Bule | 248/156 |
| 3,267,901 | 8/1966 | Carroll | 116/209 |
| 3,442,247 | 5/1969 | Osterberg | 116/63 P |
| 3,503,163 | 3/1970 | Lutz | 52/103 |
| 3,523,515 | 8/1970 | Brown | 116/209 |
| 3,758,062 | 9/1973 | Caldwell et al. | 248/156 |
| 4,006,702 | 2/1977 | St. Cyr | 116/63 P |
| 4,256,050 | 3/1981 | Barnard | 116/63 C |
| 4,257,181 | 3/1981 | Cooper | 248/530 |
| 4,649,678 | 3/1987 | Lamson | 52/103 |

*Primary Examiner*—William A. Cuchlinski, Jr.
*Assistant Examiner*—W. Morris Worth
*Attorney, Agent, or Firm*—Andrus, Sceales, Starke & Sawall

[57] ABSTRACT

A location marking device includes a hollow body adapted to function as a spike or stake for insertion into the ground, and a roll of a narrow strip of sheet material disposed within the hollow body and adapted to be withdrawn axially therefrom through one open end. Withdrawal of the coiled strip by grasping and pulling the inner end thereof forms a narrow, self-supporting conical spiral. The device provides a safe, convenient, economical and very functional means of marking the location of underground utility lines and the like.

11 Claims, 1 Drawing Sheet

LOCATION MARKING STAKE

BACKGROUND OF THE INVENTION

The present invention relates to marking devices and, more particularly, to a marking stake which is especially useful for insertion in the surface of the ground to mark the location of an underground utility line or the like.

It is often necessary to determine and mark the location of underground utilities, such as gas lines, telephone lines, electric power lines, water mains and the like, so that they will not be damaged or ruptured by subsequent excavation activity. Once the location of a utility line is determined, markers of various types are inserted in the ground at spaced intervals immediately above and along the course of the underground utility. The most commonly used markers are stakes or other long, thin devices which are inserted into the ground and extend some distance above. The upper ends of the markers may typically include a small flag or other type of visual indicia to assist in locating the marker.

Wooden stakes have been used to mark the line of underground utilities but, because of their inherent large and bulky construction, the number of stakes that a user can conveniently handle is severely restricted and marking long distances is tedious and time consuming. Wooden stakes also typically require some type of device to drive them into the ground and their inherent bulk also presents storage and transportation problems.

Long pieces of relatively narrow gauge wire have also been used for markers. Typically, a 24" length of wire with a small plastic flag attached to the upper end is inserted into the ground. The use of wire shaft markers has, however, been restricted because of the problems of safety and the need to often preliminarily form a hole in the ground by another means because the thin wire shaft will not withstand insertion without bending.

Another type of marker, intended to overcome the problems previously described comprises a long hollow plastic tube, similar to a drinking straw, with a small plastic flag attached to one end. Such markers essentially eliminate the safety hazards associated with markers having wire shafts, but these thin hollow plastic markers normally require the pre-forming of a hole in the ground to prevent bending or collapse of the thin body upon insertion. Also, the thin hollow shaft on this type of marker has a tendency to fold relatively easily at the ground line after insertion.

Markers with thin solid plastic or fiberglass shafts have been substituted for those made with wire or hollow plastic. These markers are generally considered to be somewhat safer than those using wire shafts, but their semi-rigid shafts still present a potential hazard. Preforming holes for their receipt is also very often required.

U.S. Pat. No. 3,267,901 (Carroll) describes a wooden marking stake to the top of which a cluster of strands are attached, as with a staple, to provide a "flag" to help facilitate its location.

U.S. Pat. No. 3,523,515 (Brown) describes a marking device for more or less permanently establishing the location of an underground utility line. A series of strap-like stakes are attached at spaced intervals directly to the line after it is laid and before backfilling. The marking devices are long enough to extend above the final grade after backfilling.

U.S. Pat. No. 3,758,062 (Caldwell et al) shows a disposable, multi-purpose stake which, in one embodiment, includes a small banner or flag attached to the top thereof to facilitate its location when used as a marking stake.

U.S. Pat. No. 4,649,678 (Lamson) discloses a marking stake combination including a hollow cylindrical receptacle adapted to be driven into the ground and into which a marking stake or post may be removably inserted.

All of the stakes described in the foregoing patents are much too bulky, expensive, difficult to use, or otherwise unsuitable for use in utility line location marking where large numbers of stakes are typically required. There thus remains a need for a location marking device which is inexpensive, small in size, easy to insert into the ground, safe and reliable.

SUMMARY OF THE INVENTION

The present invention is directed to a location marking device particularly adapted for use as a stake to mark the location and course of an underground utility line. The device includes a hollow body portion adapted to be inserted into the ground and a roll or coil of a narrow strip of sheet material disposed within the hollow body portion, the combination forming a solid nail-like object. The coiled strip is adapted to be pulled axially and withdrawn from the body to form a narrow, upstanding marking shaft. The strip is withdrawn by hand from the end at the center of the roll or coil to form a slender spiral taper or cone.

The body is not limited in shape and may be formed of various materials and of varying thicknesses to accommodate insertion into the ground or other surfaces of varying hardness. The end of the strip of sheet material on the outside of the roll is attached or adhered to the inside wall of the hollow body to allow the strip to be fully withdrawn and extended without removing it from the body. The strip of sheet material may be rolled in a manner to provide an integral free end to facilitate grasping for its withdrawal and, in one embodiment, the body and strip of sheet material may be integral.

The end of the body portion opposite the open end may be provided with a point to facilitate insertion into a surface or may be adapted to utilize other means of mounting or affixing the body to a surface.

The marking device of the present invention is inexpensive to manufacture, easy and convenient to use, and provides a reliable temporary means to safely and conveniently mark the location of underground utility lines or other objects.

DETAILED DESCRIPTION OF THE PREFERRED EMBODIMENT

The location marking device of the present invention includes an elongated hollow body 10 which has an open upper end 11 and is cut or otherwise formed with a tapered lower end 12 to facilitate its principal intended use as a stake or spike for insertion into the ground or other surface. The body 10 may be formed of any of various materials which are thick and rigid enough to be inserted or driven into the ground. The tubular body may thus be made, for example, of plastic, metal, or even heavy paper or cardboard, the latter preferably being treated to withstand degradation from moisture and the elements.

Figure 1:
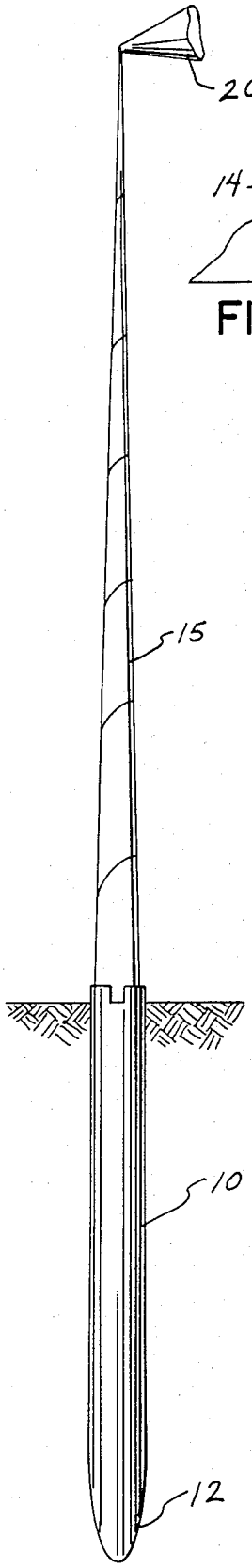
FIG. 1 is a side elevation of a location marking stake of the present invention with the marker in its operative, fully extended position.

A roll or coil 13 formed from a narrow strip 14 of sheet material is adapted to be inserted axially into the open upper end 11 of the body 10 such that the end of the strip 14 on the inside of the coil 13 may be grasped to withdraw the strip axially from the body to form a narrow, self-supporting spiral cone 15, as shown in FIG. 1.

Figure 4:
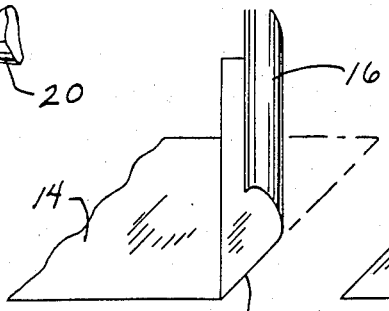
FIG. 4 is a view similar to FIG. 3 showing how the rolling of the strip of sheet material is initiated.
Figure 3:
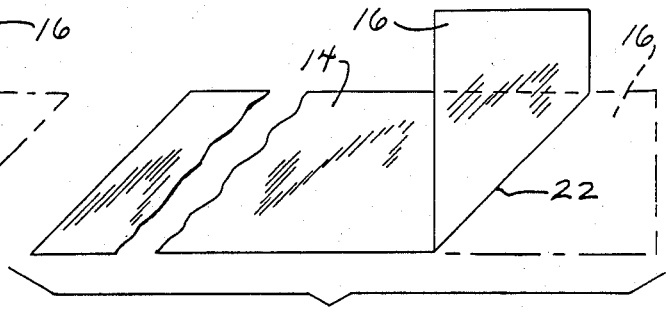
FIG. 3 is a top plan view of a section of a strip of sheet material which provides the visual marker for the subject invention and further showing how the strip is prepared for coiling or rolling.
Figure 2:
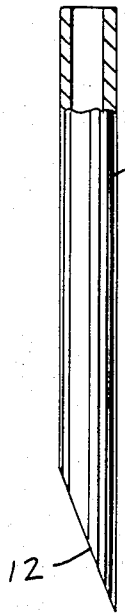
FIG. 2 is a side elevation, partly in section, showing the hollow tubular body of the marking device.
Figure 5:
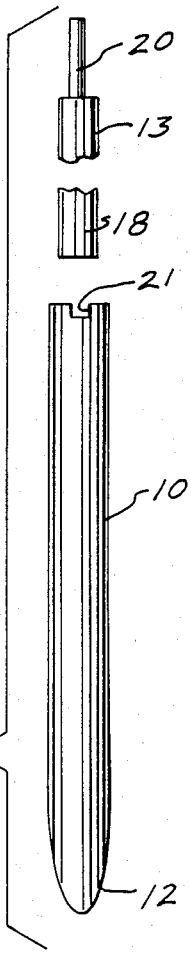
FIG. 5 is a side elevation showing the tubular body and the coil of marker material prior to insertion of the latter into the former.
Figure 6:
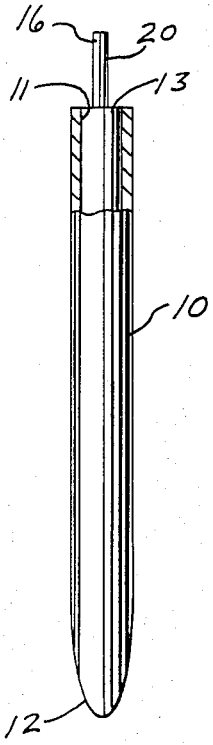
FIG. 6 is a side elevation, partly in section, showing the marking device of the present invention ready for use.
Figure 8:
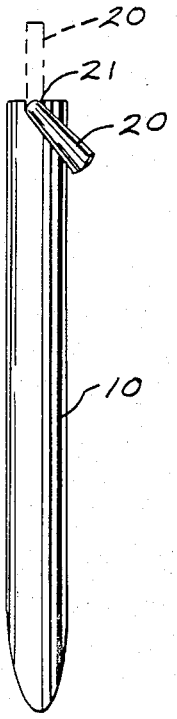
FIG. 8 is a side elevation view similar to FIG. 6 showing a modified tubular body.
Figure 7:
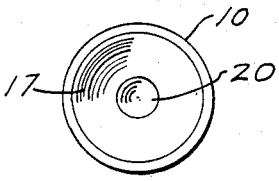
FIG. 7 is an enlarged top plan view of the device shown in FIG. 6.

The narrow strip 14 may be made from a wide variety of sheet materials, including paper or plastic. Ordinary waxed paper has been found to be suitable and various thin plastic sheet materials would likewise perform adequately. Referring particularly to FIGS. 3 and 4, the strip 14 should have a width approximately equal to the length of the cylindrical body 10, excluding the tapered lower end 12. In the preferred embodiment shown, the end of the strip 14 which is to comprise the inside end of the coil 13 is first folded along fold line 22 at an approximately 45° angle to extend laterally a short distance with respect to the principal or longitudinal orientation of the strip 14. Starting with the inside end 16, the strip 14 is rolled into a tight coil 13 such that the first few turns include the axially extended inside end 16 surrounded by the main body portion 17 of the coil.

The inside diameter of the body 10 and the length of the strip 14 are chosen such that the coil 13 may be conveniently inserted axially through the open upper end 11 of the body. Preferably, the outside diameter of the snugly wound coil 13 should be just slightly smaller than the inside diameter of the body 10.

The outer end 18 of the strip 14 forming the coil 13 is secured to the inside cylindrical surface of the body 10. Attachment may be provided by any convenient means, and a suitable adhesive has been found to work well. Thus, the entire cylindrical outside surface of the main body portion 17 of the coil 13 may be coated with a suitable adhesive prior to insertion of the coil into the open body 10. Alternately, the adhesive may be applied to the inside cylindrical surface of the body. In any event, the adhesive or other securing means is necessary to prevent separation of the strip material from the body as the former is withdrawn to deploy the marking device.

The inside end 16 of the coil 13 forms a narrow diameter tab 20 which is axially displaced from the coil and extends outside the body 10 after the coil has been inserted therein. The tab 20 provides a convenient means for grasping the strip to withdraw it axially from the body of the device. If the marking device must actually be driven into the ground or other surface, as with a mallet or hammer, the open upper end 11 of the body 10 may be provided with a small notch 21 into which the tab 20 may be bent to protect it from damage or destruction as the device is driven into the ground.

After the device is inserted into the ground or other surface at a location representative of the position to be marked, the tab 21 is grasped and the strip material withdrawn in a vertical upward direction. The nature of the strip 14 when rolled into a relatively tight coil 13 is such that its withdrawal forms the narrow, self-supporting spiral cone 15. Extension of the strip to form the cone is somewhat inherently self-limiting, provided that the outer end of the coil is properly secured within the body and a reasonable withdrawal of force is used to deploy the strip into the spiral cone. It has been found that the tab, which itself is formed from a small coil of the strip material, provides a small integral flag which assists in sighting and locating the marker once it is installed and deployed.

As an example of one marking device made in accordance with the teaching of the present invention, the tubular body 10 has a length sufficient to accommodate a 2 inch wide strip 14 of sheet material rolled into a coil 13. Thus, the main portion of the body 10 should be at least 2 inches in axial length and include an integral pointed or tapered lower end 12 adding an additional length of, for example, ½ inch to the body 10. The body may be formed of a material as thin as that used in a conventional soda straw, if the ground into which it is to be inserted is relatively soft or if holes for receipt of the device are preformed. However, where substantial axial force is required to insert the spike-like body into the ground or where it must be driven by a hammer or the like, a substantially heavier and more rigid body is required. If the cylindrical interior of the body has a diameter of about ⅛ inch, a strip of sheet material, such as waxed paper, 30 inches long may be rolled into a coil readily insertable into the hollow body. Such a coil, suitably attached to the body, may be withdrawn to form a marker shaft about 18 inches in length. The length of the conical marker shaft may, of course, be increased by increasing the length of the strip 14 from which the coil 13 is rolled. However, within the confines of a constant diameter body 10, the length of the spiral cone 15 may also be increased by increasing the width of the strip 14. This may, of course, also necessitate increasing the axial length of the body.

In an alternate embodiment, the cylindrical body of the marking device may be formed integrally with the coiled strip of sheet material. A selected length at the end 18 of the strip 14 which will be located at the outer surface of the coil 13 may be coated with a suitable adhesive before rolling such that a number of outer layers of the coil will adhere after rolling to form a laminated rigid outer shell. This outer shell may comprise the body 10 from which the coil 13, comprising the major portion of the strip length to which no adhesive has been applied, will integrally extend. In such an integral construction, it is also possible to form the laminated outer shell or body with an axially extending lower end which may be cut or formed to a point to facilitate insertion. In a manner similar to that used to form the integral tab 20 on the inside of the coil, the strip 14 at the opposite end may be likewise folded, but in the opposite lateral direction with respect to the length of the strip, such that the fully formed coil will have a downwardly depending end integral with the laminated outer shell.

When used to mark the location of a line, whether it represents the location of an underground utility, a survey line established on the surface of the ground, or the like, the marking device is rugged enough to remain operational for the full period of time normally required for prior art devices used for the same purpose. In the device of the present invention, even if the strip is withdrawn too hard or too far, either inadvertently or intentionally, such that the strip is torn from the body, the body may still remain embedded in the ground or other surface to provide some residual indication of the exact location desired to be marked.

It is also possible to utilize a body having an end which is not tapered to form a point. For example, the body may be provided with a flat lower end lying in a plane perpendicular to the longitudinal axis. The flat lower end may be provided with an adhesive for mounting and holding the marking device on a relatively smooth surface, such as roads or floors. A broader flattened base may also be provided to make the marking device self-supporting and, if desired, portable and reusable.

Various modes of carrying out the invention are contemplated as being within the scope of the following claims particularly pointing out and distinctly claiming the subject matter which is regarded as the invention.

I claim:

1. A marking device comprising:

an elongated hollow body having one open end and an opposite end including means to facilitate inserting the body into the ground; and;

a tightly wrapped roll, essentially solid in cross-section, formed of thin strip material disposed in and attached to the hollow body, an inner portion of the roll forming a tab means for permitting axial withdrawal of said roll from said body to form a rigid self-supporting spiral cone.

2. The device as set forth in claim 1 wherein the hollow body comprises a cylindrical tube.

3. The device as set forth in claim 2 wherein the opposite end of the body comprises a pointed tip to facilitate insertion of the body into the ground.

4. The device of claim 2 wherein the roll of thin strip material has its outer end attached to the body and its inner portion displaced axially from the roll to be grasped for withdrawal.

5. A location marking device comprising:

an elongated hollow body having an open upper end and a lower end adapted to be inserted into the ground; and an extensible marker formed from a tightly wound roll, essentially solid in cross-section, formed of a narrow strip of sheet material, said roll disposed within the hollow body and attached thereto, and tab means formed at the end of the strip of material on the inside of the roll to facilitate withdrawal of the material by its inner end from the open upper end of said body to form a rigid self-supporting spiral cone.

6. The device as set forth in claim 5 wherein the end of the strip of sheet material on the outside of the roll is attached to the inside surface of the hollow body.

7. The device as set forth in claim 5 wherein the lower end of the body extends axially beyond the lower end of the roll and is tapered to define a pointed end. beyond the lower end of the roll and is tapered to define a pointed end.

8. The device as set forth in claim 6 wherein the tab means comprises an integral portion of the inside end of the strip material displaced axially from the roll.

9. The device as set forth in claim 6 wherein the hollow body is cylindrical.

10. The device as set forth in claim 9 wherein the hollow body comprises an integral extension of the end of the strip of material on the outside of the coil.

11. The device as set forth in claim 10 wherein the integral extension of the strip material forming the body comprises a laminate of multiple layers of the material.

* * * * *